US005249308A

United States Patent [19]

Blume, deceased

[11] Patent Number: 5,249,308

[45] Date of Patent: Oct. 5, 1993

[54] AFTER-SHOWER HAT

[75] Inventor: Ruby L. Blume, deceased, late of Phoenix, Ariz., by Edward H. Blume, Jr., heir

[73] Assignee: Edward H. Blume, Jr., Phoenix, Ariz.

[21] Appl. No.: 977,150

[22] Filed: Nov. 16, 1992

[51] Int. Cl.[5] ..... A42B 1/00

[52] U.S. Cl. ..... 2/174; 34/96

[58] Field of Search ..... 2/171, 173.5, 174, 175, 2/192, 194, 195, 198, 200, 201, 255, 256; 34/96

[56] References Cited

U.S. PATENT DOCUMENTS

| | | | |
|---|---|---|---|
| 1,751,573 | 3/1930 | Bishinger | 34/96 |
| 2,263,418 | 11/1941 | Ganim | 2/198 |
| 2,420,358 | 5/1947 | Culligan | 34/96 |
| 2,694,204 | 11/1954 | Cross | 2/174 |
| 2,706,861 | 4/1955 | Schmeer | 34/90 |
| 2,804,695 | 9/1957 | Scott | 34/95 |
| 2,919,494 | 1/1960 | Runci | 34/96 |
| 3,019,444 | 2/1962 | Pollack | 2/174 |
| 3,088,469 | 5/1963 | Berryhill | 132/9 |
| 3,133,289 | 5/1964 | Lipschultz | 2/195 |
| 3,298,035 | 1/1967 | Gobins | 2/198 |
| 3,327,720 | 6/1967 | Carmony | 2/198 |
| 3,370,304 | 2/1968 | Pelletier | 2/174 |
| 3,708,803 | 1/1973 | Teaff | 2/198 |
| 3,929,143 | 12/1975 | Coleman | 132/36 |
| 3,962,728 | 6/1976 | Pavlinik | 2/174 |
| 4,542,595 | 9/1985 | Shon | 34/96 |
| 4,683,596 | 8/1987 | Cole | 2/174 |
| 4,691,389 | 9/1987 | Meyer | 2/195 |

FOREIGN PATENT DOCUMENTS

| | | | |
|---|---|---|---|
| 1294076 | 10/1972 | United Kingdom | 2/195 |

*Primary Examiner*—Clifford D. Crowder
*Assistant Examiner*—Diana L. Biefeld
*Attorney, Agent, or Firm*—Jordan M. Meschkow; Lowell W. Gresham; Don J. Flickinger

[57] ABSTRACT

An after shower hat is fabricated from a towel-like material. A rectangular piece of the material is folded in half. The open sides are sewn forming first and second seams, and elastic is sewn around the opening to provide a snug fit. The seams are also provided with a stiffening material, whereby when the hat is worn with the seams at the front and back of the head, the hat stands relatively straight out from the wearer's head. This permits the hair to dry without flattening.

4 Claims, 1 Drawing Sheet

AFTER-SHOWER HAT

BACKGROUND OF THE INVENTION

1. Field of the Invention

This invention relates to a hair drying apparatus, and more particularly to an after-shower hat adapted to be placed over the head of a wearer having long hair for the purpose of permitting the hair to dry naturally, without dripping.

2. The Prior Art

It is not uncommon for an individual to utilize electrically heated air to dry recently shampooed hair. The heated air is typically produced in an electric hair-dryer wherein electrically heated air is forced through and out of a nozzle due to the action of a motor driven fan. While such devices will satisfactorily dry wet or damp hair, they are inconvenient to use. First, movement of the user is restricted in that the device must be coupled to a source of electricity.

Furthermore, overheating the hair can damage it and cause it to become brittle. Finally, there is the ever-present danger of short-circuit and shock to the user.

Many attempts have been made to provide a convenient mechanism for drying hair while avoiding the above mentioned disadvantages. For example, U.S. Pat. No. 3,962,728 discloses a head turban having an opening which can be made to close tightly around the wearer's head by means of a draw string. The turban is provided with hook and loop fasteners which permit size adjustment at the front and rear top of the wearer's head.

U.S. Pat. No. 2,804,695 discloses an after shower cap that is vented and utilizes a packet of granular material which is capable of absorbing water within the cap. The cap includes an elastic band around its opening so to provide a snug fit on the wearer's head. Other hair drying bonnets made of water absorptive material such as towelling material have been proposed. See for example U.S. Pat. Nos. 2,263,418 and 2,694,204.

Unfortunately, the devices described in the above cited patents are in some cases difficult to use, and in most cases cause the hair to dry in a flattened condition.

SUMMARY OF THE INVENTION

It is an object of the present invention to provide an improved cap or bonnet which may be worn for the purpose of drying hair.

It is a further object of the present invention to provide an improved after-shower cap for drying hair without causing it to become flattened of twisted.

It is a still further object of the present invention to provide an improved after-shower cap which may be worn on heads of different sizes and accommodate even long hair.

It is yet another object of the present invention to provide an improved after-shower cap which is simple to use and inexpensive to manufacture.

According to a broad aspect of the invention there is provided an after-shower hat to be worn on the head of a user for the purpose of drying the user's hair. The hat comprises a cap of absorptive material having a closed region for confining the hair of the user and an edge defining an opening.

Two stiffening members are secured to opposite sides of the cap and extend from proximate the opening into the closed region. Elastic is coupled to the edge proximate the opening so as to provide a snug fit of the user's head. The after-shower hat extends outward from the user's head when the stiffening members are positioned at the front and back of the user's head.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENT

Figure 1:
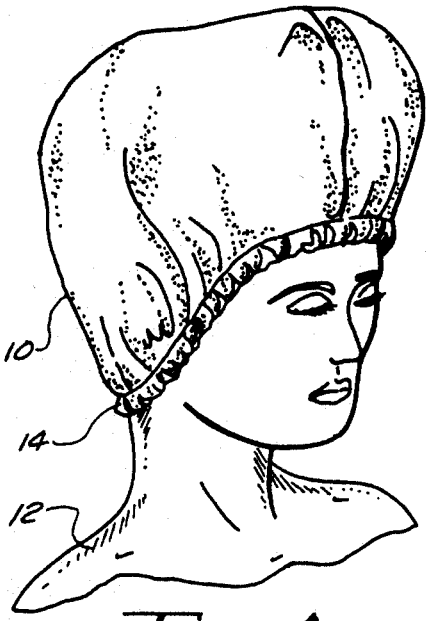
FIG. 1 illustrates, in perspective, the inventive after-shower cap worn on the head of a user.
Figure 2:
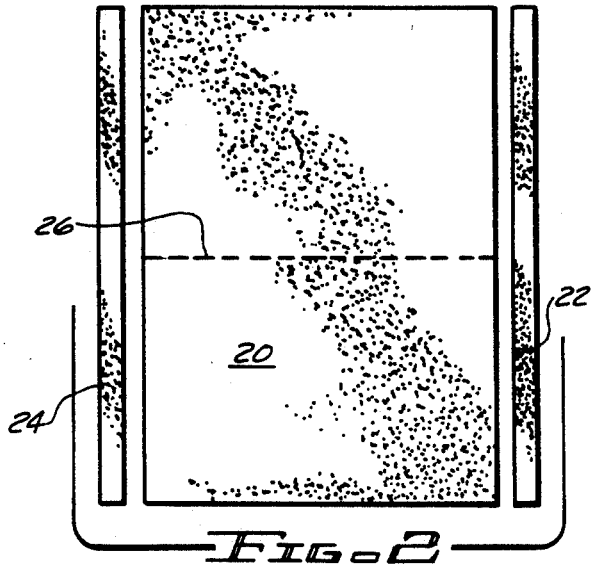
FIGS. 2, 3, and 4 illustrate the inventive after-shower cap in various stage of manufacture.

FIG. 1 illustrates the inventive after-shower cap 10 being worn on the head of a user 12. An elastic hem 14 assures a snug fit. It is to be noted that a first seam 16 is positioned centrally at the front of the user's head. A second seam 18 (not shown in FIG. 1) is centrally positioned at the rear of the user's head. When worn in this manner, the after-shower hat stands relatively straight out from the wearer's head permitting the hair to dry naturally, without dripping, to a fuller, unflattened condition.

Figure 3:
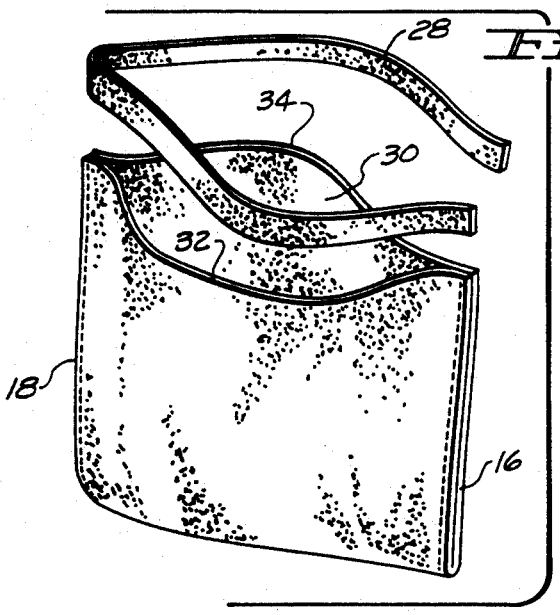

Refering to FIGS. 2–5, the inventive after-shower cap is constructed from a pieced of absorptive material 20, such as toweling material, and first and second strips of stiffening material 22 and 24 respectively. The toweling material is folded onto itself along line 27 and strips 22 and 24 placed between the layers of toweling material adjacent the opposite edges thereof. The sides are then stitched. Securing strips 22 and 24 and thus create seams 16 and 18 as is shown in FIG. 3.

Figure 4:
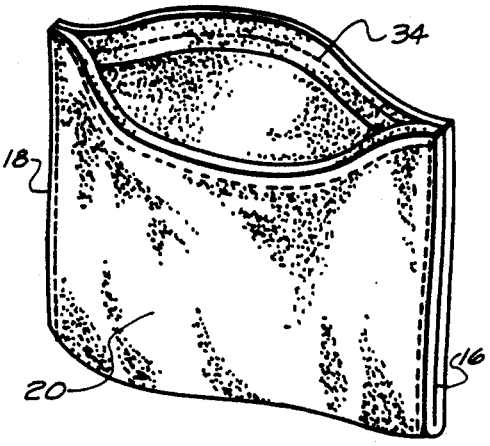
Figure 5:
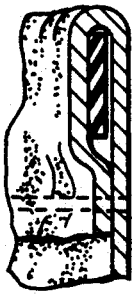
FIG. 5 is a cross-sectional view illustrating the elastic hem of the improved after-shower cap.

A strip of elastic material 28 is secured to the opening 30 by folding edges 32 and 34 inward and over elastic strip 28 and stitching such as is shown at 34 in FIG. 5. The resulting after-shower cap is shown in FIG. 4.

It should now be clear that by securing stiffening strips 22 and 24 proximate seams 16 and 18, the hat will stand relatively straight when worn as described in connection with FIG. 1, thus preventing the hair from becoming flattened.

The above description is given by way of example only. Changes in form and details may be made by one skilled in the art without departing from the scope of the invention as defined by the appended claims.

Having fully described and disclosed the instant invention in such clear and concise terms as to enable those skilled in the art to understand and practice the same, the claimed invention is set forth below.

We claim:

1. An improved after-shower hat to be worn on the head of a user for the purpose of drying the user's hair, comprising:

a cap of absorptive material having a closed region for confining the hair of said user, and said cap having an edge defining an opening, and being formed from a sheet of said absorptive material folded on itself and sewn at first and second seams;

first and second stiffening members secured to opposite sides of said cap along said first and second seams and extending from proximate said opening into said closed region; and resilient means coupled to said edge proximate said opening so as to provide a snug fit on the users head, said after-shower hat extending outward from the user's head when said first and second stiffening members are positioned at the front and back respectively of the user's head.

2. An improved after-shower hat according to claim 1 wherein said absorptive material is toweling material.

3. An after-shower hat according to claim 1 wherein said stiffening members are secured to the interior of said cap.

4. An improved after-shower hat according to claim 3 wherein said resilient means is an elastic strip.

* * * * *